United States Patent [19]

Kozacka

[11] 4,183,004

[45] Jan. 8, 1980

[54] FUSE HAVING HELICALLY WOUND FUSIBLE ELEMENT AND SUPPORT THEREFOR

[75] Inventor: Frederick J. Kozacka, South Hampton, N.H.

[73] Assignee: Gould Inc., Newburyport, Mass.

[21] Appl. No.: 895,536

[22] Filed: Apr. 12, 1978

[51] Int. Cl.[2] ..... H01H 85/38

[52] U.S. Cl. ..... 337/273; 337/158; 337/279

[58] Field of Search ..... 337/273, 279, 280, 281, 337/158, 159, 160, 161, 162, 293, 295

[56] References Cited

U.S. PATENT DOCUMENTS

| | | | |
|---|---|---|---|
| 3,573,699 | 4/1971 | Salzer | 337/161 |
| 3,881,161 | 4/1975 | Kozacka | 337/295 |
| 3,925,745 | 12/1975 | Blewitt | 337/279 |
| 4,093,932 | 6/1978 | Kozacka | 337/293 |

*Primary Examiner*—Harold Broome
*Attorney, Agent, or Firm*—Erwin Salzer

[57] ABSTRACT

An electric fuse has rod supports for the helically wound fusible element which are of a laminate of glass cloth and a synthetic resin. This is a material which is slightly gas evolving. The rods have inserts of a material which is highly gas evolving, and they provide a substantial spacing between the path of the fusible element—and the arc path—and the surface of the rod supports for it. The limited gas evolving capacity of the rods combined with the large gas evolving capacity of the inserts and combined with the spacing between the arc path and the surface of the rods allows proper operation of the fuse in the absence of any ceramic insulators or ceramic supports for the fusible element.

2 Claims, 5 Drawing Figures

FUSE HAVING HELICALLY WOUND FUSIBLE ELEMENT AND SUPPORT THEREFOR

BACKGROUND OF THE INVENTION

I have observed that insulating supports for helically wound fusible elements made of laminates of glass cloth and synthetic resins, particularly melamine resins, perform very differently depending upon the current-carrying capacity of the fusible element and depending upon the area of the interface between the fusible element and the support. In fuses having a very small current rating, wherein the fusible element is in the form of a thin wire, and the interface between the fusible element and a support for it of an organic substance as, e.g. melamine, are very small, such supports performed perfectly. As the current-carrying capacity of the fusible element is increased, and with the transition from one to a plurality of narrowly spaced fusible elements, with the substitution of wire-like fusible elements by ribbon-type fusible elements, and with the concomitant increase of the interface between the fusible elements and their organic supports, the quality of the performance of the latter decreases. It thus appears that laminates of glass cloth and synthetic resins may be used as supports for the fusible element or elements up to a certain point, beyond which point the performance of such supports becomes unacceptable.

It is, therefore, one object of this invention to provide electric fuses with helically wound fusible elements having supports therefor which are of a laminate of glass cloth and a synthetic resin and which supports perform satisfactorily in the absence of ceramic materials for supporting the fusible element, even under conditions where supports of glass cloth and synthetic resin would normally fail.

Another object of this invention is to avoid ceramic materials, and in particular high alumina content materials, for supporting helically wound fusible elements because such materials are much more expensive than laminates of glass cloth and synthetic resins, and because such materials are extremely difficult to form.

SUMMARY OF THE INVENTION

Fuses embodying the present invention include a tubular casing of electric insulating material, a pulverulent arc-quenching filler inside said casing, a pair of terminal elements closing the ends of said casing, a substantially helically wound fusible element conductively interconnecting said pair of terminal elements, and a support of a laminate of glass-cloth and a synthetic resin for supporting said fusible element.

According to the present invention a support of a laminate of glass cloth and a synthetic resin which evolves relatively small amounts of gas under the action of electric arcs has inserts, including melamine and inorganic substances at the points of cross-over of said fusible element and said support, of a substance evolving relatively large amounts of gas under the action of electric arcs, which additionally spaces said fusible element from said support member which evolves relatively small amounts of gas. The joint gas evolving action of said synthetic resin glass cloth laminate and said insert in combination with the consequent spacing of said fusible element from said support of synthetic glass cloth laminate making it possible to dispense with any kind of ceramic or non-gas evolving material for insulating the fusible element and the arc, respectively.

DESCRIPTION OF PREFERRED EMBODIMENTS

Figure 1:
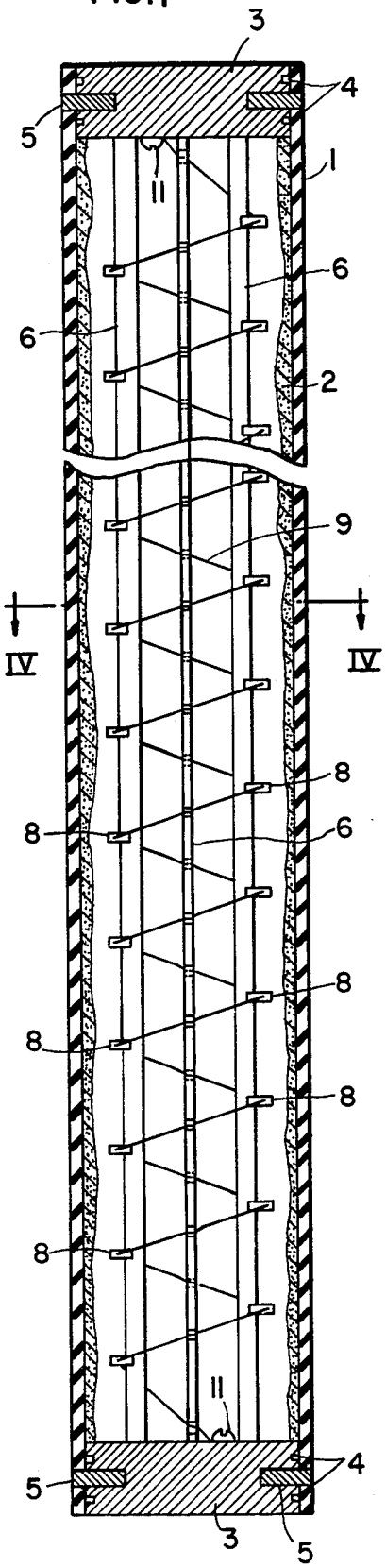
FIG. 1 is, in part, a longitudinal section and in part a front elevation of a fuse embodying the present invention.
Figure 2:
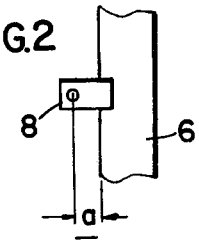
FIG. 2 is an elevation on a larger scale than FIG. 1 of a portion of a fusible element support and of a bead-like insert in the latter.
Figure 4:
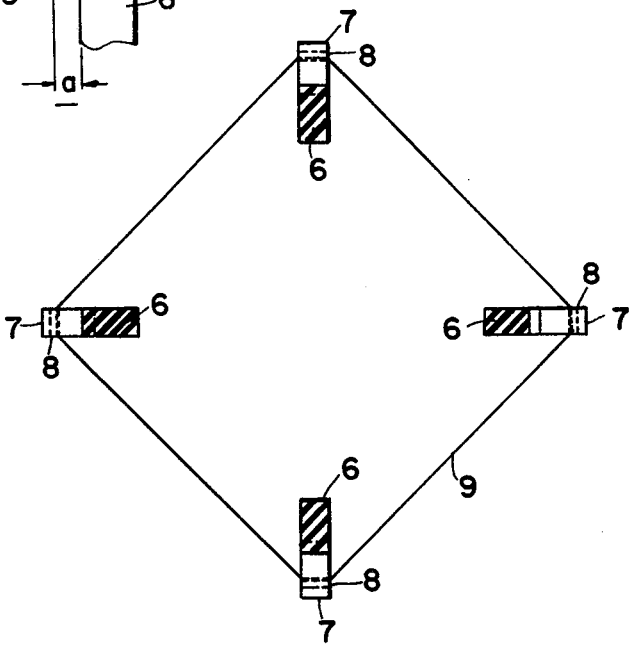
FIG. 4 is a cross-section on a larger scale than FIG. 1 taken along IV—IV of FIG. 1 of the support of the fusible element and of its bead-like inserts.
Figure 3:
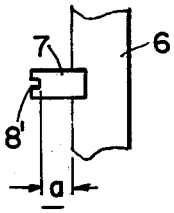
FIG. 3 is an elevation on a larger scale than FIG. 1 of a portion of a fusible element support and a grooved insert in the latter for receiving the fusible element.

Referring now to the drawings, numeral 1 has been applied to indicate a tubular casing of electric insulating material, e.g. vulcanized fiber, or steatite. Casing 1 is filled with a pulverulent arc-quenching filler 2 such as, for instance, quartz sand. While actually the whole casing 1 is filled by quartz sand or the like, except the spaces occupied by other parts, filler 1 has been shown only at its interface with casing 1. A pair of terminal elements formed by plugs 3 closes both ends of casing 1. Plugs 3 are provided with circular grooves 4 for receiving O-rings, or like seals. Pins 5, preferably of steel, project through casing 1 into plugs 3 and thus join parts 1 and 3. Four rods 6 of a laminate of glass-cloth and a synthetic resin space the upper and the lower plugs 3. The ends of rods 6 may be inserted in bores (not shown) provided in the axially inner end surfaces of plugs 3, or in grooves (not shown) provided in said end surfaces. Reference may be had to U.S. Pat. No. 3,881,161; Apr. 29, 1975 to Fredrick J. Kozacka for ELECTRIC FUSE FOR ELEVATED CIRCUIT VOLTAGES showing the engagement of rods for supporting a helically wound fusible element in bores in the axially inner end surfaces of terminal plugs. A fusible element 9 of substantially helical configuration, or a plurality of such elements, conductively interconnects terminals 3. Rods 6 are of a laminate of glass cloth and a synthetic resin, and is relatively slightly gas evolving under the action of electric arcs. Each of rods 6 is provided with a plurality of inserts 7 at the points of cross-over of fusible element 9 and the support for it formed by rods 6. These inserts are made of a substance evolving relatively large amounts of gas under the action of electric arcs such as, for instance, aqueous dispersions of melamine and inorganic substances, in particular alumina trihydrate. The inserts are disposed in appropriately formed recesses in the support rods 6 as shown in FIGS. 2 and 3. The provision and positioning of these inserts allows the rods 6 to be made of laminates of glass cloth and synthetic resins which are much cheaper than ceramic materials and much easier to form than ceramic materials. As shown in FIGS. 1 and 2 each insert 7 is provided with a bore 8 through which fusible element 9 is threaded. This gives rise to oppositely directed blasts of gas on blowing of the fuse at moderate overloads. The cross-section of rods 6 is rectangular to increase the dimensional stability thereof. The ends of fusible element 9 are screwed by means of screws 11 against the axially inner end surfaces of plug terminals 3.

It will be apparent from the above that under very adverse conditions the surfaces of rods 6 may become conductive to some extent, particularly since rods 6 are made of ordinary laminates of glass cloth and synthetic resins which have no particular antitracking ingredients. The spacing a between the hole 8 for conductor or fusible element 9 and the surface of rods 6 may be made sufficiently large to avoid tracking of rods 6 to a serious extent. In other words, the distance a may be made sufficiently large to space the arc sufficiently far apart from rods 6 to preclude rods 6 from tracking significantly, though their anti-tracking capacity is relatively limited due to their chemical composition.

Figure 5:
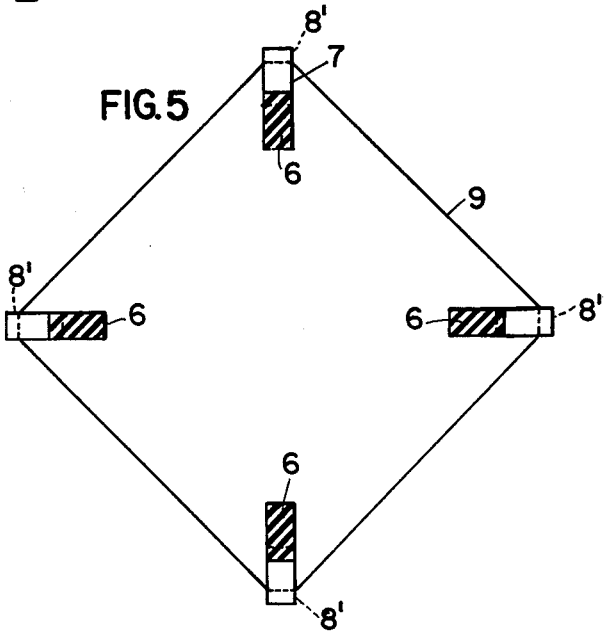
FIG. 5 is a cross-section of the same nature as shown in FIG. 4 wherein the inserts for receiving the fusible element are grooved rather than bead-shaped.

FIGS. 3 and 5 show rods 6 of a laminate of glass cloth and a synthetic resin that are provided with inserts of a dried paste comprising an acqueous suspension of melamine resin and alumina trihydrate. Such a material is highly gas evolving under the action of electric arcs. The inserts 8 are provided with grooves 8′ which receive the fusible element or elements. The distance a between the bottom of grooves 8′ and the surface of rods may be varied so as to limit tracking in spite of the limited antitracking ability of rods 6.

I claim as my invention:

1. An electric fuse including a tubular casing of electric insulating material, a pulverulent arc-quenching filler inside said casing, a pair of terminal elements closing the ends of said casing, a substantially helically wound fusible element conductively inter-connecting said pair of terminal elements, and a support of a laminate of glass-cloth and a synthetic resin for supporting said fusible element wherein the improvement comprises in that said support of a laminate of glass-cloth and a synthetic resin which evolves relatively small amounts of gas under the action of electric arcs has inserts including melamine and inorganic substances at the points of cross-over of said fusible element and said support, said inserts are capable of evolving relatively large amounts of gas under the action of electric arcs so that said fusible element and the electric arc which takes its place are effectively insulated by said support in the absence of any ceramic insulating material.

2. An electric fuse including a tubular casing of electric insulating material, a pulverulent arc-quenching filler inside said casing, a pair of terminal elements closing the ends of said casing, a substantially helically wound fusible element conductively interconnecting said pair of terminal elements and a plurality of rods of a laminate of glass-cloth and a synthetic resin forming a slightly gas evolving support for said fusible element wherein said rods are provided with inserts of a highly gas evolving material including melamine and inorganic substances directly supporting said fusible element, and disposed in appropriately formed recesses in said support rods, which inserts provide such a spacing between the fusible element and the surfaces of said support that the limited gas evolution from said rods and the high gas evolution of said inserts coupled with the magnitude of said spacing allows proper operation of said fuse without excessive tracking in the absence of any ceramic non-gas evolving insulation of said fusible element and of the electric arc that takes its place.

* * * * *